United States Patent [19]

Parker

[11] 4,137,014

[45] Jan. 30, 1979

[54] TWO SPEED COMPRESSOR WITH ROTOR SUPPORT STRUCTURE

[75] Inventor: Sidney A. Parker, Ft. Worth, Tex.

[73] Assignee: Lennox Industries, Inc., Dallas, Tex.

[21] Appl. No.: 806,604

[22] Filed: Jun. 15, 1977

Related U.S. Application Data

[63] Continuation of Ser. No. 601,471, Aug. 4, 1975, abandoned.

[51] Int. Cl.[2] ..... F04B 17/00; F04B 35/04

[52] U.S. Cl. ..... 417/326; 417/415; 417/902

[58] Field of Search ..... 417/363, 326, 902, 424, 417/410, 415; 310/90, 91, 51; 308/9, 72, 194, 207 R; 62/228, 295

[56] References Cited

U.S. PATENT DOCUMENTS

| | | | |
|---|---|---|---|
| 2,139,313 | 12/1938 | McKinley et al. | 417/410 |
| 2,792,512 | 5/1957 | Koch | 310/90 |
| 2,794,691 | 6/1957 | Noe | 308/194 |
| 3,107,626 | 10/1963 | Thoren et al. | 417/424 |
| 3,234,881 | 2/1966 | Ekey | 417/424 |
| 3,302,048 | 1/1967 | Gray | 308/72 |
| 3,565,553 | 2/1971 | Rinehart et al. | 417/424 |
| 3,614,384 | 10/1971 | Heitchue | 417/902 |
| 3,942,912 | 3/1976 | Cawley | 417/53 |
| 3,955,112 | 5/1976 | Sell | 417/902 |

*Primary Examiner*—Carlton R. Croyle
*Assistant Examiner*—Thomas I. Ross
*Attorney, Agent, or Firm*—Allegretti, Newitt, Witcoff & McAndrews

[57] ABSTRACT

This invention pertains to a multi-speed refrigerant compressor, for example, a two speed compressor operable at a relatively high speed and at a relatively low speed. Such compressor includes an electric drive motor having a fixed stator and a rotor electrically coupled to the stator and rotatable relative to the stator, a drive shaft or crankshaft driven by the rotor, and vibration dampening means engaging an end of the drive shaft or crankshaft preventing undesirable vibration thereof that could cause rubbing between the stator and the rotor of the electric drive motor during low speed operation, during high speed operation, switching from high to low speed operation, switching from low to high speed operation, start up at low speed, and start up at high speed operation.

5 Claims, 4 Drawing Figures

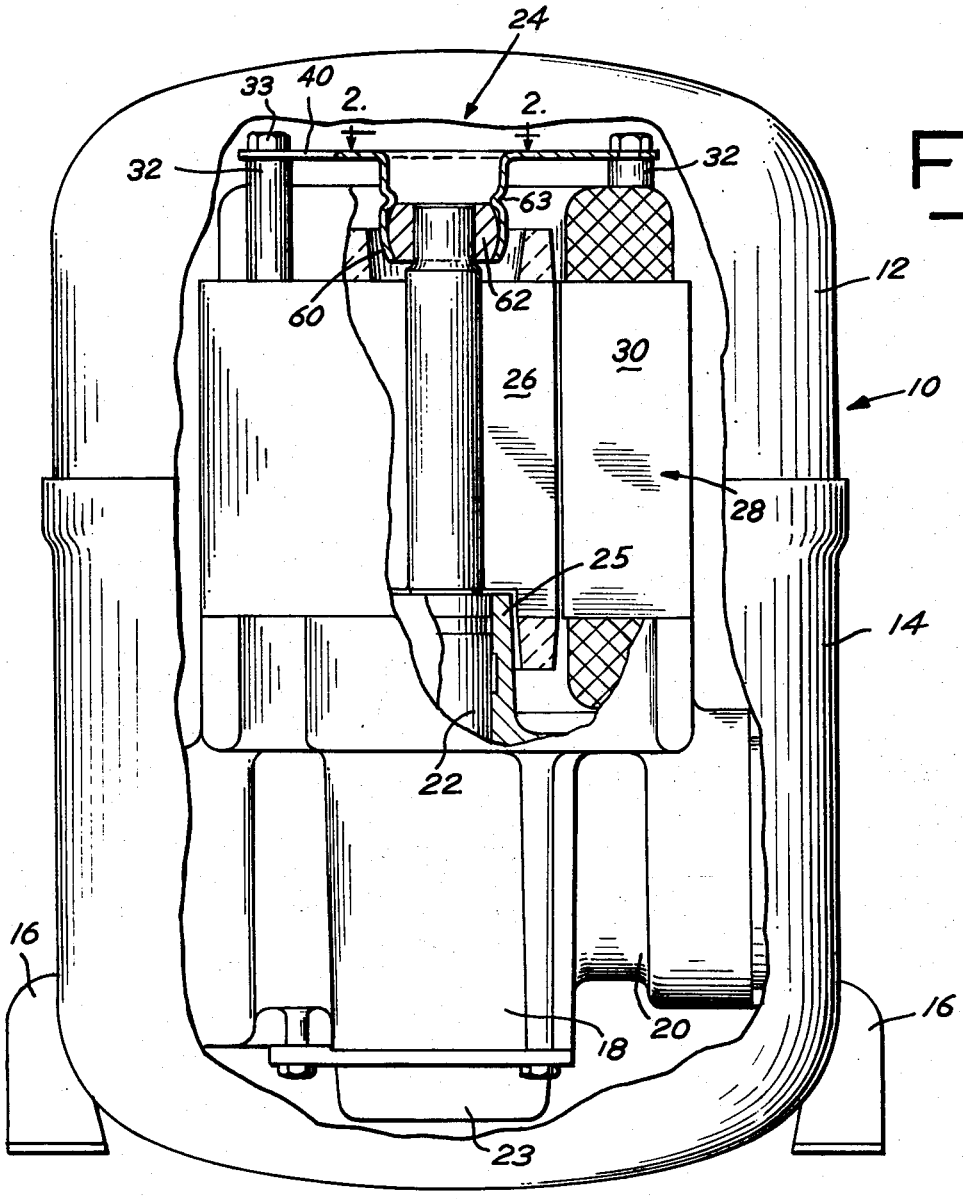
Fig. 1.
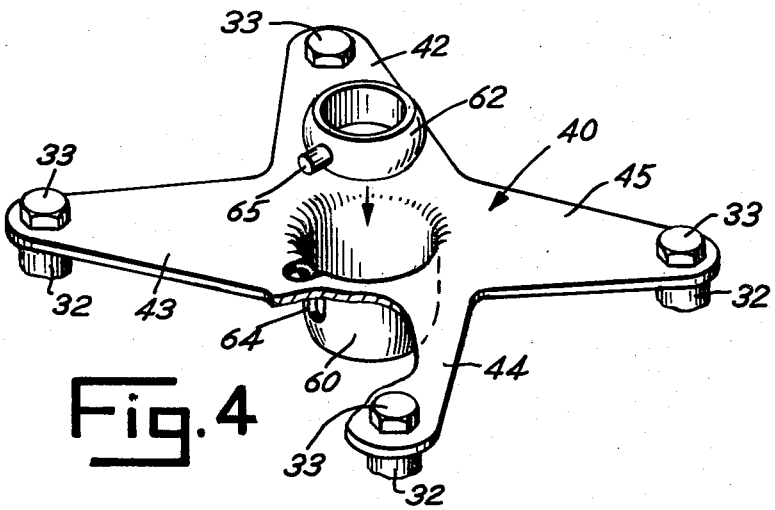
Fig. 4
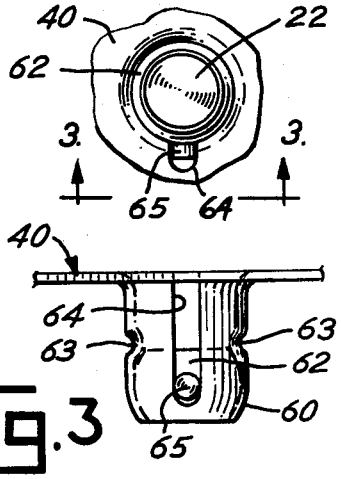
Fig. 2
Fig. 3

TWO SPEED COMPRESSOR WITH ROTOR SUPPORT STRUCTURE

This is a continuation of application Ser. No. 601,471 filed Aug. 4, 1975, now abandoned.

BACKGROUND OF THE INVENTION

This invention relates to a refrigerant compressor and, more particularly, to a refrigerant compressor having a multi-speed drive motor therein and incorporating vibration dampening bearing means for minimizing vibration of the drive shaft particularly during low speed operation and high speed operation and starting up at high speed and low speed, thereby preventing rubbing between the rotor secured to and driving the drive shaft and the fixed stator of the drive motor.

A recent advance in refrigerant compressors has been the two-speed refrigerant compressor. Such compressor includes a two-speed electric motor operable at a high speed and at a low speed, thereby providing capacity control and economy of operation. In larger compressors of the two-speed type, there is sufficient mass in the drive shaft to minimize the vibration. It has been found, however, in some smaller sized refrigeration compressors, where the drive shaft extends above the upper bearing, the portion above the upper bearing will sometimes deflect and thereby vibrate during low speed operation or high speed operation, as well as starting at both speed of the refrigerant compressor so as to cause rubbing or contact between the rotor carried on the upper portion of the drive shaft and the stator which is fixed to the compressor mechanism. This particular problem is accentuated in single phase two-speed compressors in the smaller sized ranges. The precise cause of the problem is not known at this time, though it is recognized that the problem does exist in a lesser form in larger multi-speed compressors, where the crankshaft or drive shaft is stiffer in relation to its size.

An object of the present invention is to provide an improved multi-speed refrigerant compressor incorporating vibration dampening bearing means for the upper end of the drive shaft so as to prevent rubbing between the rotor carried on the upper portion of the drive shaft and the fixed stator during low speed and high speed operation, as well as start up operations at both speeds.

Another object of the present invention is to provide an improved refrigerant compressor of the two-speed type, wherein an end of the drive shaft may deflect in use, for example during low and high speed operation, switching from high to low speed, or vice versa, and at start up at low or high speed modes of operation, with vibration dampening means on the stator cooperating with the end of the drive shaft so as to eliminate rubbing between the stator and the rotor.

Yet another object of this invention is to provide an improved two-speed refrigerant compressor having a drive shaft subject to deflection at one end during use with a self-aligning vibration dampening bearing fixed relative to the stator and journalling the said one end of the drive shaft so as to prevent the undesirable deflection thereof in use.

A feature of this invention is the provision in a multi-speed refrigerant compressor, e.g., a two-speed refrigerant compressor, comprising compression mechanism, cylinder means in said compression mechanism, piston means in said cylinder means, a drive shaft for actuating the piston means, an electric drive motor including a stator and a rotor electrically coupled thereto, said rotor being connected to said drive shaft for rotating the drive shaft, bearing means for journalling the drive shaft, and vibration dampening means on the side of the motor opposite the bearing means for engaging the drive shaft and preventing undesirable vibration thereof that could cause rubbing between the stator and the rotor during operation of the multi-speed motor.

Other objects, advantages and features of the present invention will be made more apparent in the specification which follows.

BRIEF DESCRIPTION OF THE DRAWING

There is shown in the attached drawing a presently preferred embodiment of the present invention, wherein:

FIG. 1 is an elevation view of a refrigerant compressor embodying the present invention, with parts broken away to better show the vibration bearing dampening means:

FIG. 2 is a detailed plan view taken generally along the line 2—2 of FIG. 1 and illustrating a portion of the top of the vibration dampening bearing means;

FIG. 3 is a detailed elevation view taken generally along the line 3—3 of FIG. 2 and illustrating the vibration dampening means and particularly, the interconnection between the self-aligning bearing and the cup-like central portion of the plate member of the vibration dampening bearing means; and FIG. 4 is a perspective view better illustrating the vibration dampening bearing means and the manner of connecting the self-aligning bearing to the plate member.

DETAILED DESCRIPTION OF THE INVENTION

Referring to FIG. 1 there is illustrated a compressor 10 embodying the present invention. The compressor 10 comprises a hermetically enclosed outer casing or housing that includes an upper shell 12 and a lower shell 14 integrally joined to one another, as for example, by welding. The compressor is supported in an upright position in use by the legs 16 that are welded to the exterior surface of the lower shell 14.

Suitably supported within the outer casing of the compressor 10, as for example, by resilient spring means (not shown) is a compression mechanism 18. Within the compression mechanism are a plurality of radially oriented cylinders 20, each of which is provided with a piston reciprocable therein. The pistons within the cylinders 20 are driven by a drive shaft or crankshaft 22. The crankshaft 22 is journalled within the compression mechanism by bearing means including lower bearing 23. The upper end of the drive shaft or crankshaft 22 is journalled by means of the vibration dampening bearing means 24 of the present invention, as will be more fully explained later.

Secured to the compression means 18 is electric drive motor 28 for rotating the drive shaft 22.

The motor 28 includes the stator 30, which is secured to the compression mechanism by means of the four uprights 32 and the rotor 26 which is electrically coupled to the stator. The rotor 26 is shrunk-fit upon or otherwise suitably joined to the drive shaft 22 to drive same when the motor is energized.

In two-speed compressors of the type shown, wherein the drive shaft 22 is of relatively small mass and cross section and is supported by lower bearing means 23 on one side of the motor 28 and an intermediate bearing 25 in the compression mechanism on the same side of the motor as bearing means 23, there is substantial deflection of the upper end of the drive shaft which results in vibration thereof and rubbing between the rotor 26 secured to the upper end of the drive shaft 22 and the stator 30 which is affixed to the compression mechanism. By utilizing the vibration dampening bearing means 24 of the present invention on the side of the motor 28 opposite from the lower bearing 23 and intermediate bearing 25, the deflection and vibration problem described is obviated, particularly, where it is most apparent, namely, in single phase two-speed refrigerant compressors and three phase two-speed refrigerant compressors.

The vibration dampening means 24 comprises a plate member 40 which incorporates a plurality of arm segments, for example, four segments 42, 43, 44 and 45. The arm segments each have openings therein for receiving the upper ends of the bolts 33 which secure the plate member 40 to the posts 32. The plate member or flange 40 incorporates a central cup-like portion 60 for receiving the self-aligning bearing 62. The interior of the cup-like portion 60 and the exterior of the bearing 62 have complementary contoured curved surfaces so as to permit pivotal movement of the bearing 62 within portion 60 of plate member 40. The bearing 62 is received in the central cup-like portion and is staked in place as indicated at 63 in FIGS. 1 and 3 to prevent vertical movement of the self-aligning hydrodynamic bearing 62 relative to the drive shaft 22 which is received and journalled therein. An elongated slot 64 is provided in the central cup-like or bell-like portion 60 for receiving and retaining the projection 65 on the bearing 62 so as to prevent rotation of the bearing in use.

In operation, suction gases returning from the refrigerant system will enter the outer shell and pass into the cylinder means 20 where the gas will be compressed by the piston means. The compressed discharge gas will pass through a discharge line from the compressor 10 and to the refrigeration system. Since the rotor 26 and the stator 30 of the motor 28 are inductively coupled with one another, when the compressor motor 28 is energized, the rotor 26 will rotate relative to the stator 30, causing rotation of the drive shaft 22. By use of the present invention, during both high and low speeds operation of compressor 10, the forces that could cause deflection of the upper end of the drive shaft above the bearing means in the compression mechanism are snubbed, and rubbing between the motor and the stator is substantially reduced or eliminated altogether.

It has been determined that the vibration problem noted could be alleviated by means of a stiffer drive shaft construction, however, to increase the diameter of the drive shaft to stiffen same would necessitate a larger diameter motor which would allow for a larger rotor bore size. For those skilled in the art of motor compressor design, there is a relationship of cost to motor size that must be adhered to. This would be an expensive solution to the present problem and would make the cost prohibitive in terms of salability. The present invention permits use of present motor designs and thereby provides a simple and economical solution.

While there has been shown and described a presently preferred embodiment of the invention, it will be obvious that other embodiments will be apparent to those skilled in the art. It is, therefore, intended that the invention be limited only within the scope of the appended claims.

I claim:

1. In a refrigerant compressor, the combination of a housing, compression mechanism resiliently supported in said housing, said compression mechanism including cylinder means, piston means in said cylinder means, a drive shaft for actuating said piston means, a multi-speed motor including a stator and a rotor electrically coupled thereto, said rotor being connected to said drive shaft for rotating the drive shaft, bearing means for journalling the drive shaft, including a first bearing at an end of the drive shaft and a second bearing intermediate the ends of the drive shaft and vibration dampening means on the side of the motor opposite the second intermediate bearing for engaging the drive shaft and preventing undesirable vibration thereof that could cause rubbing between the stator and the rotor during operation of the motor, said vibration dampening means comprising a self-aligning bearing engaging an end of the drive shaft and a plate member having a bell-like central portion, said plate member being secured at the upper end of the stator, with the bell-like central portion receiving said self-aligning bearing that engages with the end of the drive shaft to prevent undesirable vibration thereof and thereby prevent rubbing between the stator and the rotor secured to the drive shaft, the self-aligning bearing being affixed within the bell-like central portion, and the bell-like central portion and the self-aligning bearing having cooperating means therebetween to prevent rotation of the self-aligning bearing in use.

2. A compressor as in claim 1 wherein the motor is a two-speed motor, operable at a relatively high speed and at a relatively low speed.

3. A compressor as in claim 2, wherein the vibration dampening means comprises a self-aligning hydrodynamic bearing.

4. The compressor of claim 1 wherein the self-aligning bearing has a projection extending outwardly therefrom and the bell-like central portion has a slot for receiving and engaging the projection extending from the self-aligning bearing to prevent rotation thereof in use.

5. The compressor as in claim 4 wherein the exterior of the self-aligning bearing and the interior of the bell-like central portion have complementary surfaces so as to permit pivotal movement of the self-aligning bearing within the bell-like central portion.

* * * * *